US008490250B2

(12) United States Patent
Lanz

(10) Patent No.: US 8,490,250 B2
(45) Date of Patent: Jul. 23, 2013

(54) INTERLOCKING EXTENSION POLES AND TOOL HOLDER

(75) Inventor: Scott M. Lanz, Oregon City, OR (US)

(73) Assignee: TCM Consulting LLC, Oregon City, OR (US)

( * ) Notice: Subject to any disclaimer, the term of this patent is extended or adjusted under 35 U.S.C. 154(b) by 6 days.

(21) Appl. No.: 13/311,503

(22) Filed: Dec. 5, 2011

(65) Prior Publication Data

US 2012/0144626 A1 Jun. 14, 2012

Related U.S. Application Data

(60) Provisional application No. 61/420,310, filed on Dec. 6, 2010.

(51) Int. Cl.
*B25G 3/00* (2006.01)
*B25G 1/04* (2006.01)

(52) U.S. Cl.
USPC ..... 16/429; 16/436; 16/427

(58) Field of Classification Search
USPC ..... 16/429, 427, 422, 405, 436; 81/177.1, 81/177.2, 489; 15/143.1, 144.1, 144.4, 145, 15/159.1, 235.8, 236.3; 294/57, 19.1, 19.2, 294/19.3; 403/107, 109.1, 109.4, 377
See application file for complete search history.

(56) References Cited

U.S. PATENT DOCUMENTS 2,076,918 A * 4/1937 Robison ..... 285/82
2,527,256 A 10/1950 Jackson
3,253,310 A * 5/1966 McCarthy ..... 24/607
3,362,050 A * 1/1968 McCarthy ..... 24/656
3,423,781 A * 1/1969 Henson ..... 15/145
3,854,832 A 12/1974 Cowper
4,518,162 A * 5/1985 Oates ..... 482/93
4,943,182 A 7/1990 Hoblingre
5,094,464 A * 3/1992 Musacchia, Sr. ..... 473/582
5,464,301 A * 11/1995 Kramer ..... 403/322.3
5,520,164 A 5/1996 Huddleston
6,029,535 A * 2/2000 Kenny et al. ..... 74/473.3
6,126,359 A * 10/2000 Dittrich et al. ..... 403/349
7,311,061 B1 * 12/2007 Wiese ..... 116/173
2005/0271466 A1 * 12/2005 Perez et al. ..... 403/322.2
2009/0208281 A1 * 8/2009 Noh ..... 403/349
2009/0245924 A1 * 10/2009 Whitling et al. ..... 403/13

* cited by examiner

*Primary Examiner* — Chuck Mah
(74) *Attorney, Agent, or Firm* — Schwabe, Williamson & Wyatt

(57) ABSTRACT

An extension pole and tool holder apparatus is described. A first rod has a distal end and a proximal end, and a first rod aperture extending from the distal end toward the proximal end. It also includes a transversely-extending aperture portion that is longitudinally spaced from the distal end. A second rod also has distal and proximal ends, the second rod being disposed in a telescoping, longitudinally-moveable arrangement with respect to the first rod. The second rod typically has a second rod aperture with a longitudically-extending aperture portion extending from the distal end toward the proximal end. A third rod has a protruding member extending transversely outwardly therefrom, the third rod being mountable within the first and second rods such that the protruding member is trapped within the transversely-extended aperture portion of the first rod aperture and the longitudinally-extended aperture portion of the second rod aperture.

20 Claims, 10 Drawing Sheets

INTERLOCKING EXTENSION POLES AND TOOL HOLDER

CROSS REFERENCE TO RELATED APPLICATIONS

This application claims priority under 35 U.S.C. §119(e) to U.S. Provisional Patent Application No. 61/420,310 entitled "INTERLOCKING EXTENSION POLES AND TOOL HOLDER," filed Dec. 6, 2010, the disclosure of which is incorporated herein by reference.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure. Unless otherwise indicated herein, the approaches described in this section are not prior art to the claims in the present disclosure and are not admitted to be prior art by inclusion in this section.

It is often advantageous to mount certain tools on the end of an extension pole to reach inconvenient or inaccessible areas without the use of ladders, scaffolding, and the like. The most widely recognized application of such tool mounting extension poles is in connection with paint rollers, paint brushes, window washing squeegees, etc. Traditional tool mounting extension poles have threaded bores that allow a user to screw on tools and additional pole sections. The threaded bores generally adhere to industry-accepted size and thread pattern, so that tools of various types and manufacturers may be substantially served by extension poles of various types and manufacturers. Unfortunately, once screwed onto the end of a traditional extension pole, a tool is often susceptible to undesirable and inadvertent loosening and unscrewing during use. Moreover, when tightly installed, the tool is substantially fixed in position, making attachment, detachment, and use of the tool awkward and difficult.

SUMMARY

An extension pole and tool holder apparatus is described including first, second and third rods, with a tool typically being mounted to the third rod. One aspect of the invention includes a first rod that has a distal end and a proximal end, and a first rod aperture extending from the distal end toward the proximal end. The first rod aperture also includes a transversely-extending aperture portion that is longitudinally spaced from the distal end. The second rod has distal and proximal ends, the second rod being disposed in a telescoping, longitudinally-moveable arrangement with respect to the first rod. The second rod typically has a second rod aperture with a longitudinally-extending aperture portion extending from the distal end toward the proximal end. The third rod has a protruding member extending transversely outwardly therefrom, the third rod being mountable within the first and second rods such that the protruding member is trapped within the transversely-extended aperture portion of the first rod aperture and the longitudinally-extended aperture portion of the second rod aperture.

Another aspect of the invention provides an extension pole and tool holder apparatus including first, second and third substantially cylindrical rods, each of which includes a distal and proximal end. The first rod includes a first rod aperture extending from the distal end toward the proximal end, the first rod aperture including a longitudinally-extending portion and a circumferentially-extending portion, wherein the longitudinally-extending portion is at the distal end of the first rod, and the circumferentially-extending portion extends from a proximal end of the longitudinally-extending portion. The second rod has a second rod aperture extending from the distal end toward the proximal end, the second rod aperture comprising a circumferentially-extending portion and a longitudinally-extending portion, wherein the circumferentially-extending portion is at the second rod distal end and the longitudinally-extending portion extends longitudinally from a proximal end of the circumferentially-extending portion. The third rod has a protruding member extending radially outwardly from each side thereof, the third rod being mountable within the first and second rod such that the protruding member is trapped within the circumferentially-extended portion of the first rod aperture and the longitudinally-extended portion of the second rod aperture.

Yet another aspect of the invention provides an extension pole and tool holder apparatus with first, second and third substantially cylindrical rods, the first rod including a first rod aperture extending from the distal end toward the proximal end. The first rod aperture includes a longitudinally-extending portion and a circumferentially-extending portion, wherein the longitudinally-extending portion is at the distal end of the first rod, and the circumferentially-extending portion is disposed proximally of the distal end. The second rod is disposed in a telescoping arrangement with the first rod and is biased in a distal direction with respect to the first rod. The second rod includes a second rod aperture extending from the distal end toward the proximal end, the second rod aperture including a circumferentially-extending portion and a longitudinally-extending portion, wherein the circumferentially-extending portion is at the second rod distal end. It also includes a locking collar mounted to the outermost of the first and second rods, the locking collar being mounted to a radially-inwardly extending locking assembly. The collar is rotatable in a first direction to lock the relative position of the first and second rods with respect to each other, and rotatable in a second direction to unlock the relative position of the first and second rods with respect to each other. The third rod includes a protruding member extending radially outwardly therefrom, the third rod being mountable within the first and second rods such that the protruding member is trapped within the circumferentially-extended portion of the first rod aperture and the longitudinally-extended portion of the second rod aperture.

BRIEF DESCRIPTION OF THE DRAWINGS

Subject matter is particularly pointed out and distinctly claimed in the concluding portion of the specification. The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings, in which:

DETAILED DESCRIPTION

Figure 1:
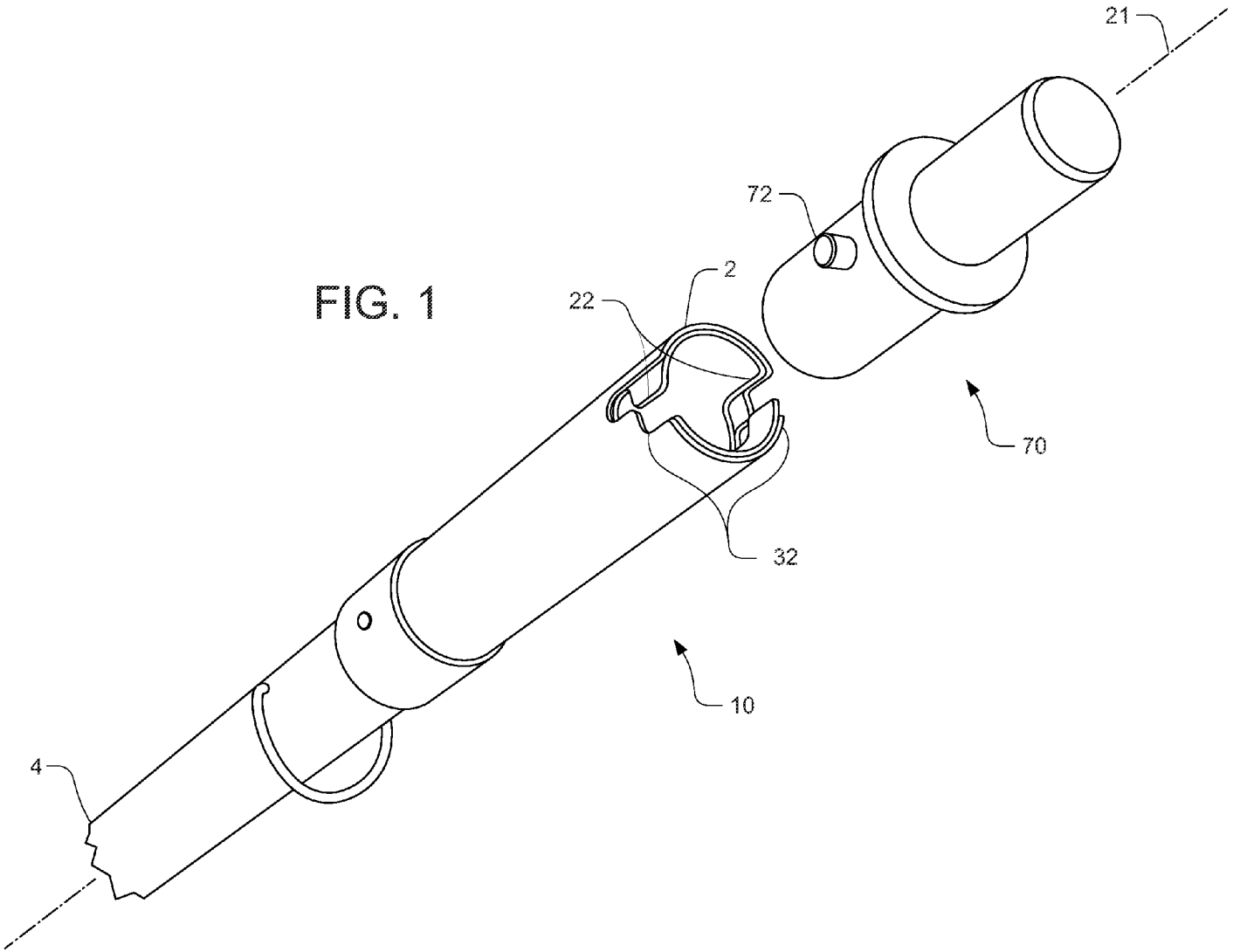
FIG. 1 is a side perspective view of an interlocking extension pole and tool holder, in accordance with an embodiment.

Reference will now be made to the drawings wherein like numerals refer to like parts throughout. For ease of description, the components of embodiments of the present disclosure are described in the normal (upright) operating position, and terms such as upper, lower, horizontal, etc., are used with reference to this position. It will be understood, however, that the components of embodiments of the present disclosure may be manufactured, stored, transported, used, and sold in an orientation other than the position described.

Figures illustrating the components of embodiments of the present disclosure show some conventional mechanical elements that may be known and that may be recognized by one skilled in the art. The detailed descriptions of such elements that are not necessary to an understanding of the disclosure, and accordingly are herein presented only to the degree necessary to facilitate an understanding of the novel features of the present disclosure.

As used herein and in the appended claims, the term "comprising" is inclusive or open-ended and does not exclude additional unrecited elements, compositional components, or method steps. Accordingly, the term "comprising" encompasses the more restrictive terms "consisting essentially of" and "consisting of."

It must be noted that, as used in this specification and the appended claims, the singular forms "a," "an," and "the" include plural references unless the content clearly dictates otherwise. Similarly, the use of substantially any plural terms herein may be translated by those having skill in the art from the plural to the singular as is appropriate to the context and/or application. The various singular/plural permutations may be expressly set forth herein for sake of clarity.

In those instances where a convention analogous to "at least one of A, B, and C, etc." is used, in general such a construction is intended in the sense one having skill in the art would understand the convention (e.g., "an apparatus having at least one of A, B, and C" would include but not be limited to apparatuses that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art, all language such as "up to," "at least," "greater than," "less than," and the like include the number recited and refer to ranges which can be subsequently broken down into subranges as discussed above. Finally, as will be understood by one skilled in the art, a range includes each individual member. Thus, for example, a group having 1-3 elements refers to groups having 1, 2, or 3 elements. Similarly, a group having 1-5 elements refers to groups having 1, 2, 3, 4, or 5 elements, and so forth.

Unless defined otherwise, all technical and scientific terms used herein have the same meaning as commonly understood by one of ordinary skill in the art to which embodiments of the present invention pertain. Although a number of methods and materials similar or equivalent to those described herein can be used in the practice of the present invention, the preferred materials and methods are described herein.

FIG. 1 depicts a first embodiment of an interlocking extension pole and tool holder 10 with the tool holder being removed. The extension pole and tool holder 10 has a distal end 2, a proximal end 4, and apertures 22 and 32 disposed at each side of distal end 2, offset by 180 degrees. For purposes of simplifying this detailed description, the apertures on only one side of extension pole and tool holder may sometimes be described and depicted in the following discussion.

A tool-mounting section 70, which may be inserted at distal end 2 of extension pole and tool holder 10, is also depicted. Tool-mounting section 70 typically has radially protruding members 72 (also depicted in FIG. 1B) positioned such that when the tool-mounting section is mounted to extension pole and tool holder 10, the protruding members extend through apertures 22 and 32, thereby allowing the coupling of the tool-mounting section 70 to the extension pole and tool holder. While two radially-protruding members are shown in the depicted embodiment, it is possible that only one such protruding member would be included, for example, if apertures 22 and 32 were provided on only one side of extension pole and tool holder 10.

Figure 2:
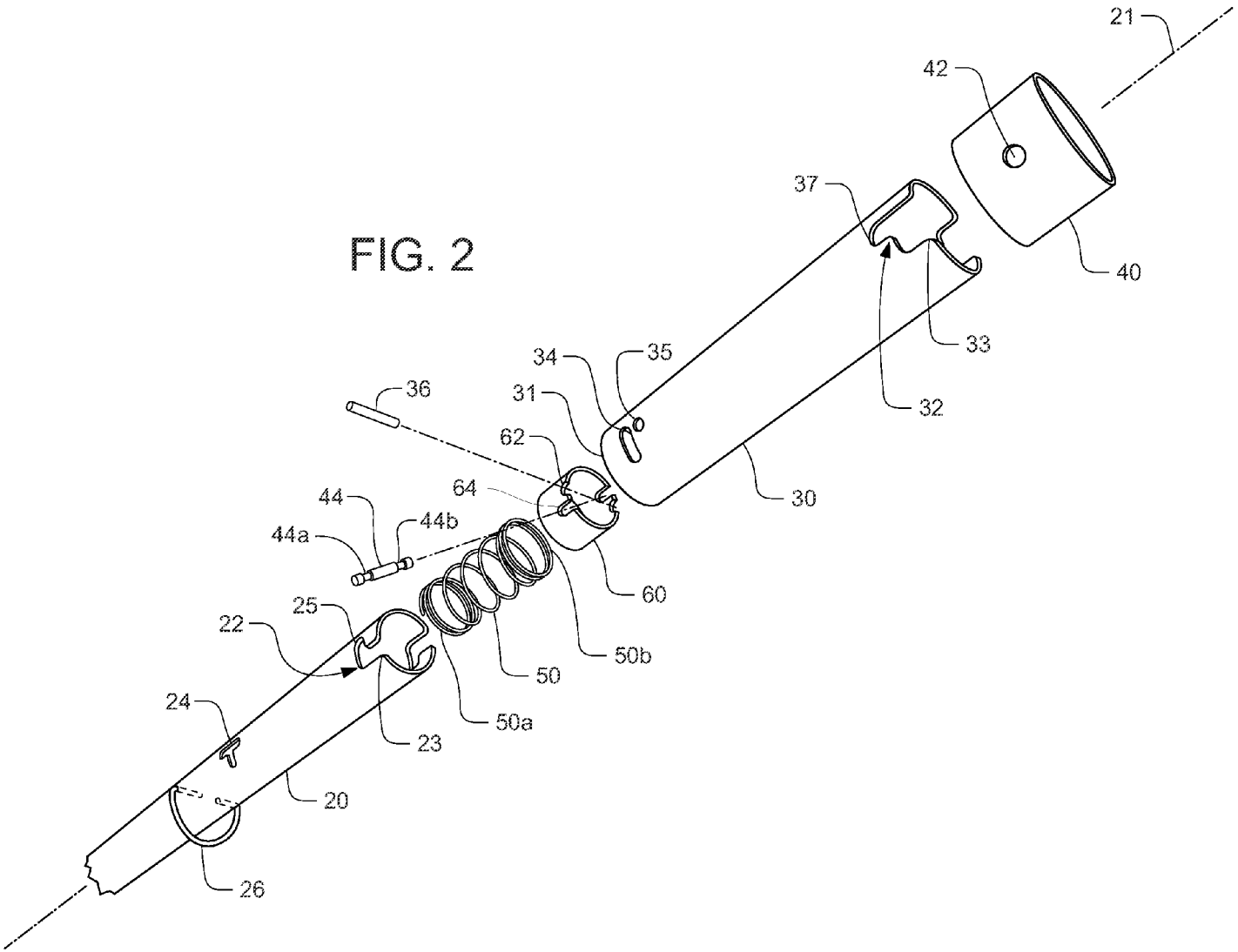
FIG. 2 is a side exploded perspective view of the interlocking extension pole and tool holder, in accordance with the embodiment of FIG. 1.

As depicted in FIG. 2, the interlocking extension pole and tool holder 10 includes a handle member 20, a retaining sleeve 30, and a locking member, normally in the form of a locking collar 40. Handle member 20 will sometimes herein be referred to as a first rod; retaining sleeve 30 will sometimes be referred to herein as a second rod; and tool-mounting section 70 will sometimes be referred to herein as a third rod. While the figures depict the preferred cylindrical configuration, it should be understood that the rods do not have to be cylindrical, but my be square, rectangular or any other shape in cross-section.

Aperture 22 is disposed at the distal end of the handle member 20. As shown best in FIGS. 2 and 3B-C, handle member aperture 22 includes a longitudinally-extending portion 23 and a circumferentially-extending portion 25, the longitudinally-extending portion 23 being at the distal end of handle member 20, and the circumferentially-extending portion 25 extending circumferentially from the proximal end of the longitudinally-extending portion 23. Or, stated another way, the longitudinally-extending portion 23 is at the distal end of handle member 20, and the circumferentially-extending portion 25 is proximally spaced from the distal end. Another way to describe the circumferentially-extending portion 25 is that it is transversely-extending, for example if handle member 20 and retaining sleeve 30 are not cylindrical in configuration.

Figure 3A:
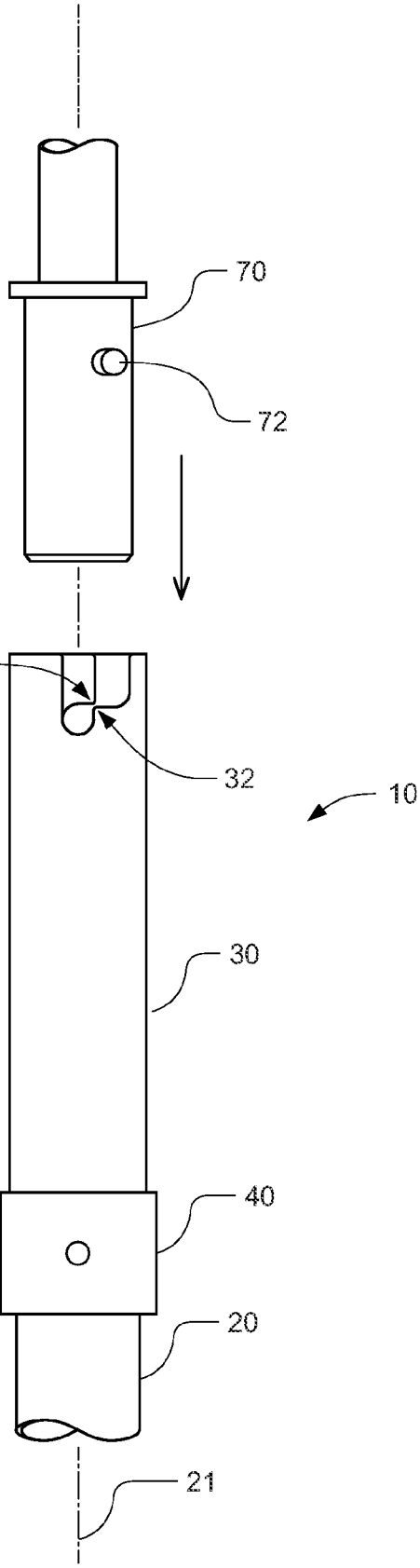
FIGS. 3A-E are side views of a pole section being inserted and locked into the interlocking extension pole and tool holder, in accordance with the embodiment of FIG. 1.
Figure 3B:
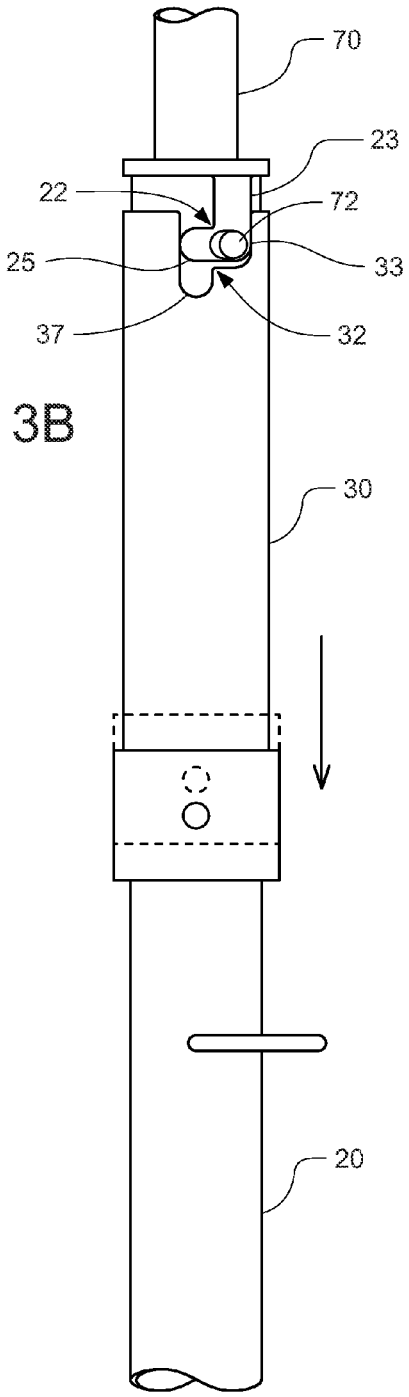
Figure 3C:
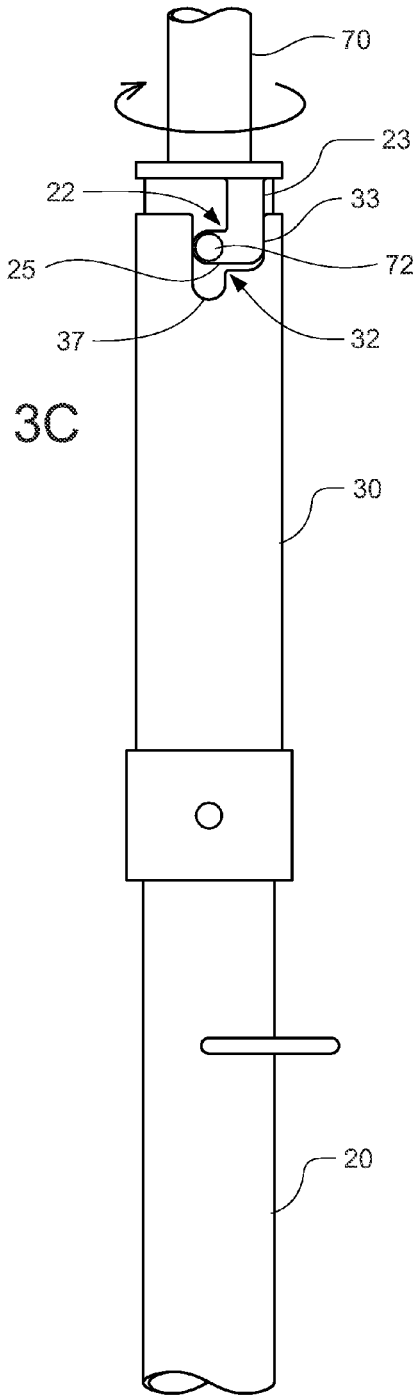
Figure 3D:
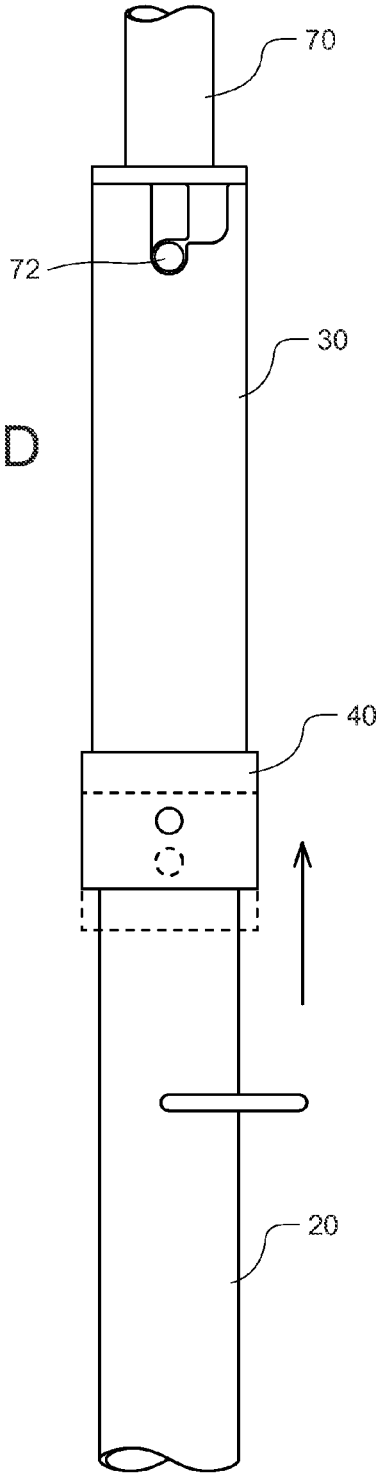
Figure 3E:
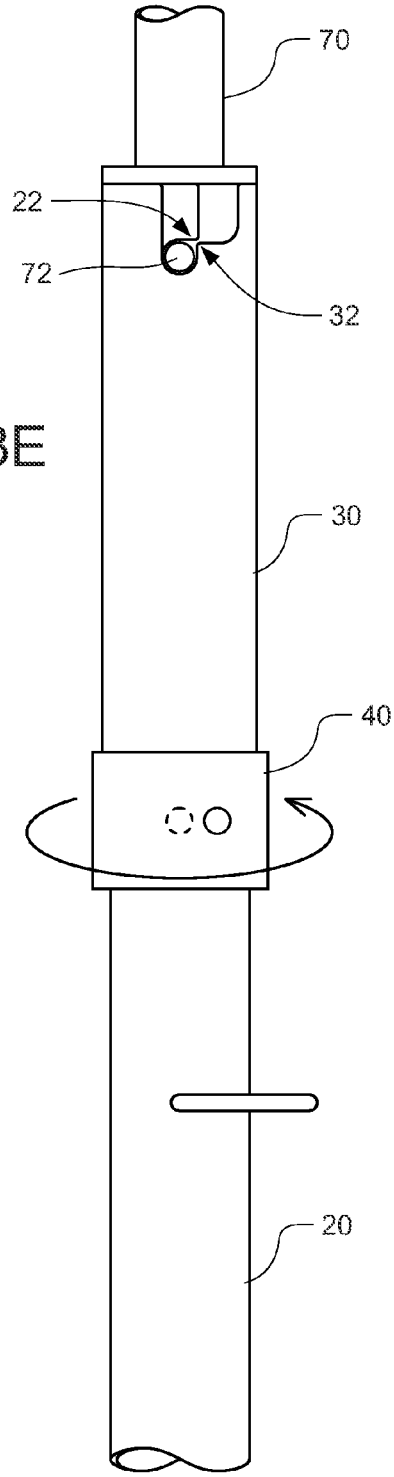

As shown best in FIGS. 2 and 3B-C, aperture 32 is disposed at the distal end of the retaining sleeve 30, and includes a circumferentially-extending portion 33 and a longitudinally-extending portion 37 that extends longitudinally from the proximal end of circumferentially-extending portion 33. Or, stated another way, retaining sleeve aperture 32 includes a circumferentially-extending portion 33 at the distal end of retaining sleeve 30, and a longitudinally-extending portion 37 that is contiguous with and extends longitudinally from one side of the proximal end of circumferentially-extending portion 33. In the depicted embodiment the longitudinally-extending portion 37 of retaining sleeve aperture 32 extends from the side of the retaining sleeve aperture that is remote from longitudinally-extending portion of the 23 of handle portion aperture 22. Again, another way to describe the circumferentially-extending portion 33 is that it is transversely-extending, particularly if handle member 20 and retaining sleeve 30 are not cylindrical in configuration.

It can be seen in FIGS. 3A-C that in the depicted embodiment the side edges of handle member aperture 22 and retaining sleeve aperture 32 substantially conform to each other at least in part. Or, more precisely, the right side of longitudinally-extending portion 23 of handle member aperture 22 and the right side of circumferentially-extending portion 33 of retaining sleeve aperture 32 substantially conform to each other. It can also be seen that the left edge of handle member aperture 22, that is, the left edge of circumferentially-extending portion 25, and the left edge of retaining sleeve aperture 32, and the left edge of longitudinally-extending portion 37, also conform. With retaining sleeve 30 in its retracted position shown in FIGS. 3B-C, it can be seen that the proximal edge of circumferentially-extending portion 25 of handle member aperture 22 also substantially conforms to, or is slightly below, the proximal edge of circumferentially-extending portion 33 of retaining sleeve aperture 32.

Handle member 20 and retaining sleeve 30 have the same longitudinal axis 21 and fit snugly but longitudinally slidably with respect to each other. In the depicted embodiment they would not be rotatable with respect to each other. In their initial positions shown in FIG. 3A, the distal ends of handle member 20 and retaining sleeve 30 are in axial alignment. In the depicted embodiment, locking collar 40 also has the same longitudinal axis 21 and fits snugly but rotatably over retaining sleeve 30 adjacent a proximal end 31 of the retaining sleeve. In some embodiments (not depicted) the collar may be displaceable in a manner other than being rotated.

Returning to FIG. 2, the depicted handle member 20 can be seen to include a T-shaped slot 24. The term "slot" as used herein is used in its broadest sense to mean any type of opening or hole, not necessarily one that is long and narrow or T-shaped, unless so described. The depicted retaining sleeve 30 includes a transversely or circumferentially-extending opening 34 and a hole 35 adjacent proximal end 31 thereof. In the depicted embodiment hole 35 is positioned adjacent but slightly distally of opening 34. When handle member 20 and retaining sleeve 30 are positioned with their distal ends in alignment as depicted in FIG. 3A, opening 34, hole 35 and T-shaped slot 24 are disposed adjacent each other, with opening 34 and hole 35 being disposed radially outwardly of T-shaped slot 24.

As shown best in FIG. 2, handle member 20 may also include an engagement member such as a ring member 26 that is positioned even further toward the proximal end than T-shaped slot 24. In the depicted embodiment each end of ring member 26 extends into handle member 20. As shown best in FIG. 2, a biasing member such as a spring 50 may be positioned within handle member 20. as shown best in FIGS. 4A and 4B, a proximal end 50*a* of spring 50 abuts the portion(s) of engagement member or ring member 26 that extend into the handle member. The term "engagement member" as used herein may describe a member of any shape as long as it engages the proximal end of the biasing member. The term "ring member" as used herein should not be considered to require that the member be ring-shaped in configuration. The term merely means that at least a portion of the member surrounds a portion of the extension pole and tool holder 10.

Also positioned within handle member 20 is a locking assembly extending into the handle member to facilitate locking of handle member 20 and retaining sleeve 30 with respect to each other. The locking member may be described as extending radially into handle member 20 if the handle member is cylindrical in configuration. In the depicted embodiment the locking assembly includes a pin assembly ring 60, shown best in FIGS. 2, 4A, 4B, 4E and 4F. Pin assembly ring 60 is positioned at a distal end 50*b* of spring 50 so that the spring resiliently holds the pin assembly ring in position distally spaced from ring member 26. Pin assembly ring 60 has two axially-extending grooves: a slight groove 62 and a deep groove 64. The depicted structure is one way to provide the bias, in the distal direction, of retaining sleeve 30 with respect to handle member 20.

A radially-extending sleeve pin 36 is positioned within handle member 20 and retaining sleeve 30 as shown in FIGS. 2 and 4A-H. Locking collar 40 is positioned snugly but rotatably on retaining sleeve 30. Locking collar 40 includes a collar aperture 42 that extends entirely through the locking collar and is designed to receive a radially-extending locking collar pin 44. Locking collar pin 44 has a pair of spaced narrowed portions 44*a* and 44*b* to facilitate engagement of the locking collar pin in pin assembly ring 60.

Figure 4A:
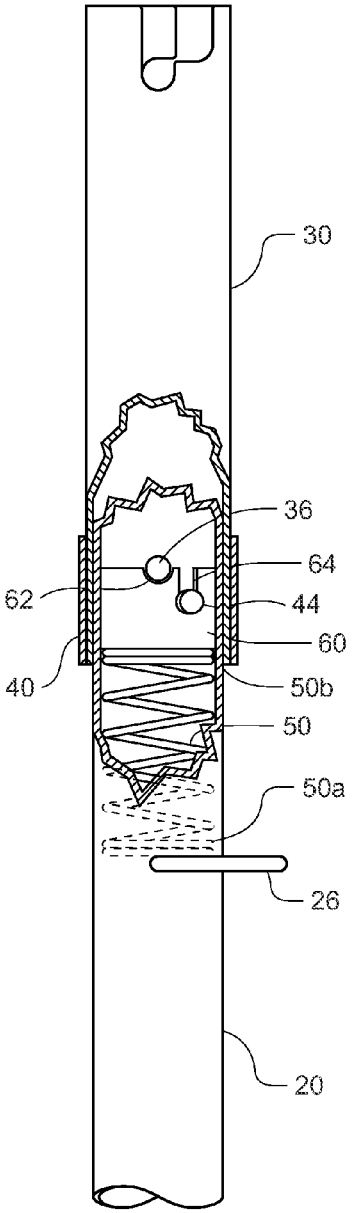
FIGS. 4A-C are side cutaway views of the locking mechanism in the locked position, in accordance with the embodiment of FIG. 1.
Figure 4B:
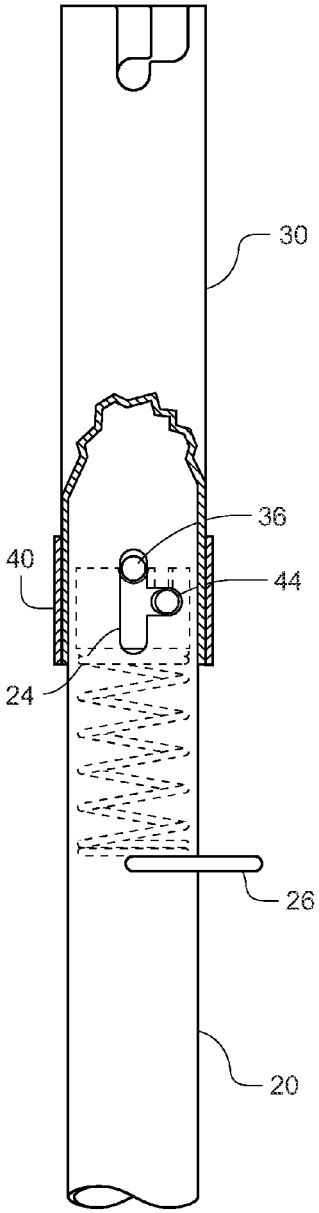
Figure 4C:
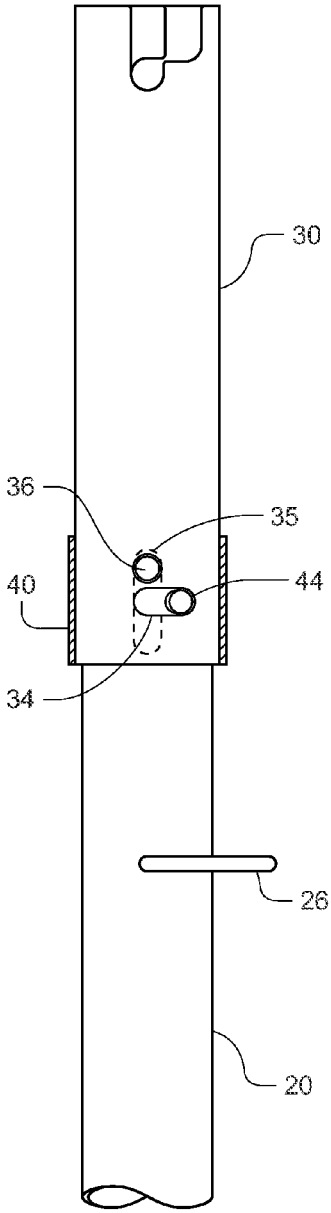
Figure 4D:
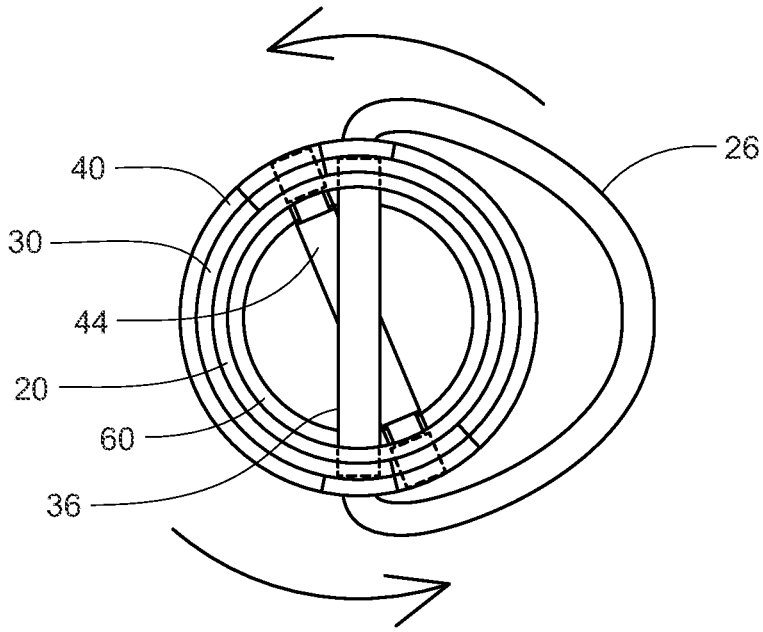
FIG. 4D is an end view of the interlocking extension pole and tool holder in the locked position, in accordance with the embodiment of FIG. 1.

FIGS. 4A-D depict the relative positions of sleeve pin 36, locking collar pin 44, pin assembly ring 60, T-shaped slot 24, opening 34 and hole 35, from the deepest to the shallowest layer, when the depicted embodiment 10 is in its locked position. FIG. 4A depicts the deepest layer, showing the relative positions of the sleeve pin 36 and locking collar pin 44 with respect to pin assembly ring 60. FIG. 4B depicts the median layer, showing the relative positions of the pins with respect to T-shaped slot 24. FIG. 4C depicts the shallowest layer, showing the relative positions of the pins with respect to opening 34 and hole 35. FIG. 4D is an end view showing these various components looking downward or from the distal end.

Figure 4E:
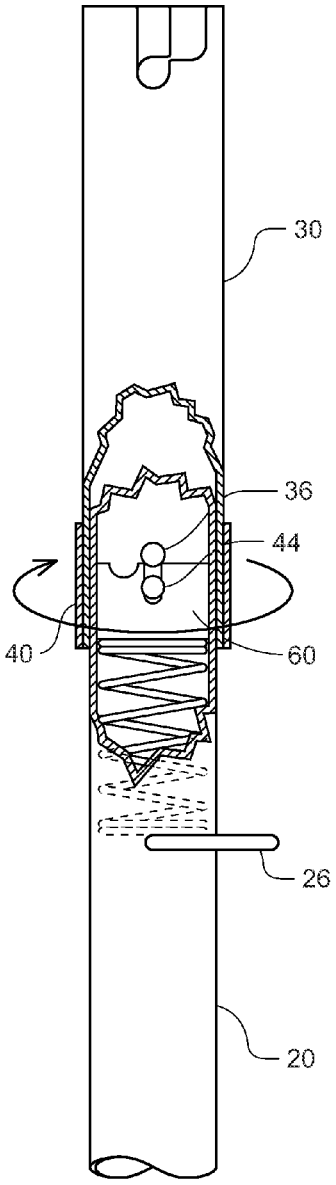
FIGS. 4E-G are side cutaway views of the locking mechanism in the unlocked position, in accordance with the embodiment of FIG. 1.
Figure 4F:
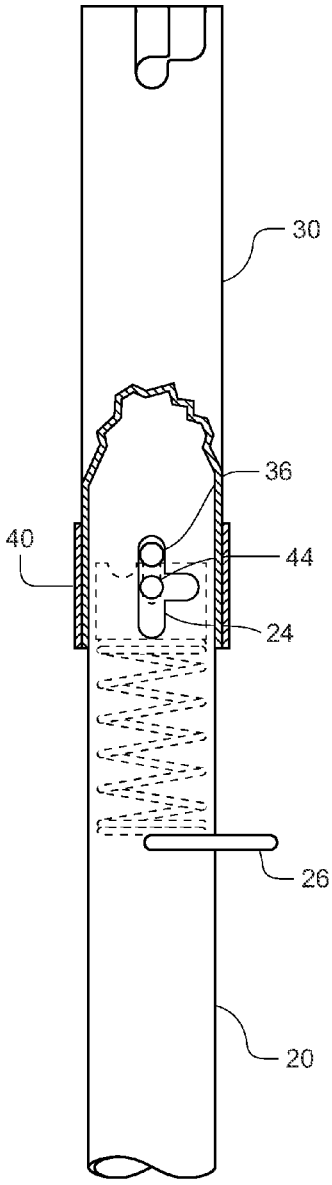
Figure 4G:
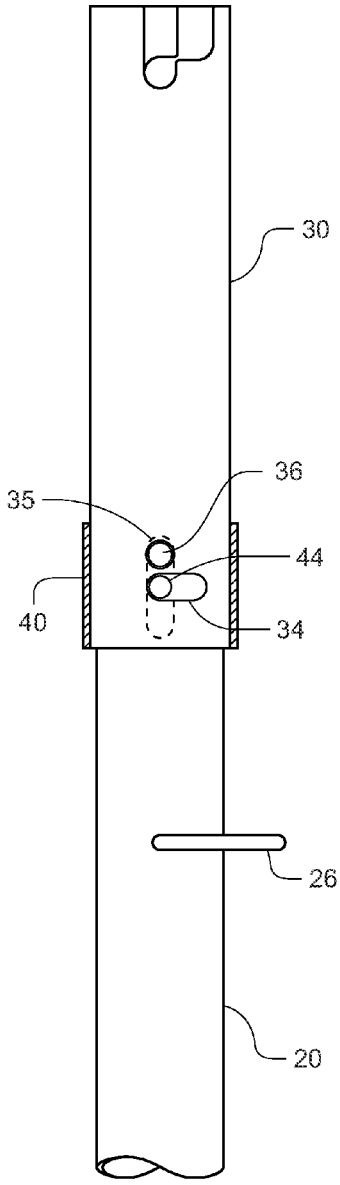
Figure 4H:
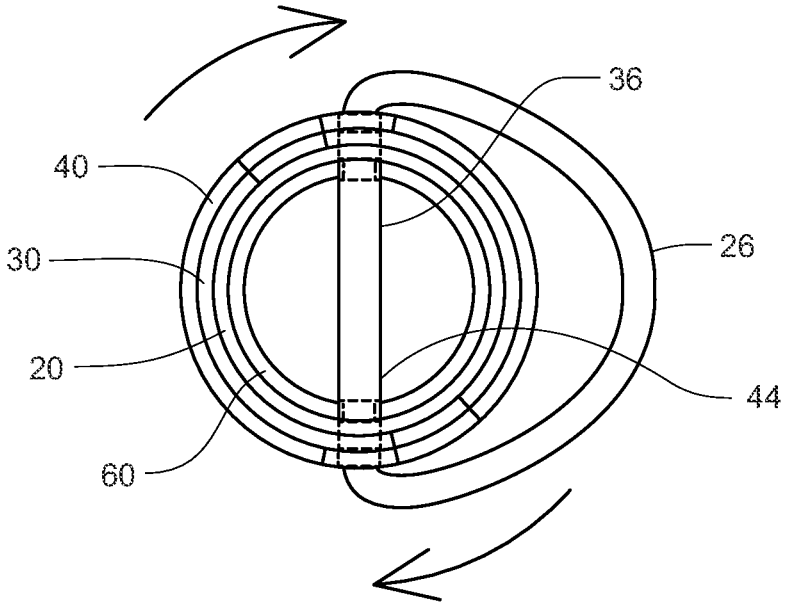
FIG. 4H is an end view of the interlocking extension pole and tool holder in the unlocked position, in accordance with the embodiment of FIG. 1.

FIGS. 4E-H depict the relative positions of sleeve pin 36, locking collar pin 44, pin assembly ring 60, T-shaped slot 24, opening 34 and hole 35, from the deepest to the shallowest layer, when the depicted embodiment 10 is in its unlocked position. FIG. 4E depicts the deepest layer, showing the relative positions of sleeve pin 36 and locking collar pin 44 with respect to the pin assembly ring 60. FIG. 4F depicts the median layer, showing the relative positions of the pins with respect to T-shaped slot 24. FIG. 4G depicts the shallowest layer, showing the relative positions of the pins with respect to opening 34 and hole 35. FIG. 4F, like FIG. 4D, is an end view showing these various components looking downward or from the distal end.

As can be seen from FIGS. 4A-D, in the locked position, retaining sleeve 30 cannot be retracted longitudinally toward the proximal end due to the position of locking collar pin 44 within T-shaped slot 24 and opening 34; that is, there is no space for longitudinal movement. In contrast, in the unlocked position depicted in FIGS. 4E-H, retaining sleeve 30 and locking collar 40 can be retracted longitudinally toward the proximal end because of the position of locking collar pin 44 within T-shaped slot 24 and opening 34; now there is space for longitudinal movement. Described another way, the locking assembly prevents relative longitudinal movement between the first and second rods when sleeve pin 36 and collar pin 44 are not radially parallel with each other, and allows such longitudinal movement when the sleeve pin and the collar pin are radially parallel with each other.

In order to assemble the depicted extension pole and tool holder 10, retaining sleeve 30 is slid over the handle member 20, and spring 50 is compressed between ring member 26 at the proximal end and pin assembly ring 60 at the distal end until the distal edges of apertures 22 and 32 are axially aligned as shown in FIG. 3A. With the retaining sleeve 30 in this position, sleeve pin 36 can be inserted through T-shaped slot 5 24 and hole 35. Sleeve pin 36 initially rests on slight groove 62 of pin assembly ring 60 when in the locked position (as shown in FIG. 4A), but may rest on top of deep groove 64 when in the unlocked position (as shown in FIG. 4E). Next, locking collar 40 is slipped over retaining sleeve 30 and slid proximally down the sleeve until locking collar pin 44 may be inserted through collar aperture 42, T-shaped slot 24 and opening 34, 10 and thereby hold locking collar 40 in position on retaining sleeve 30. Positioned thusly, locking collar pin 44 rests in deep groove 64 of pin assembly ring 60.

Figures 1A, 1B:
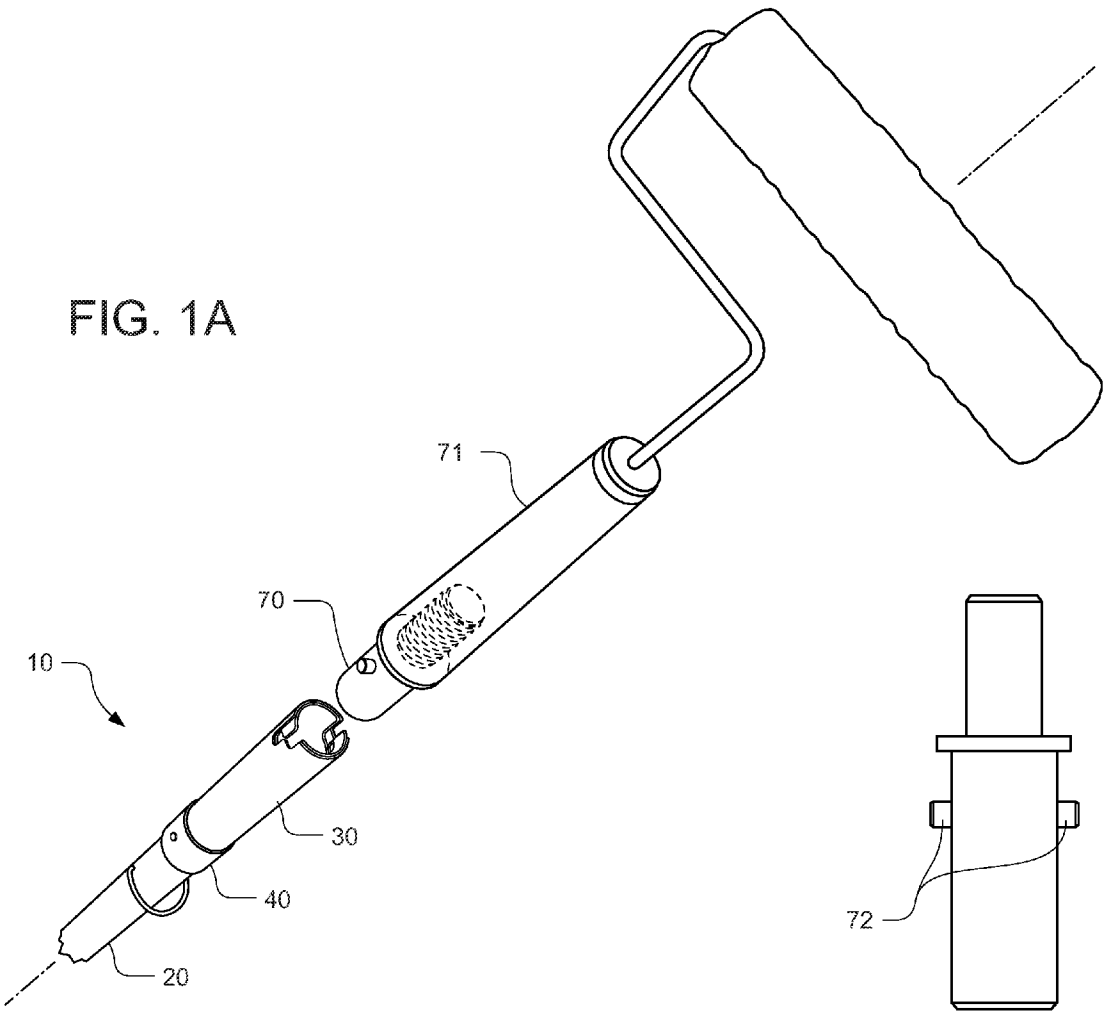
FIG. 1A is a side perspective view of the interlocking extension pole and tool holder in accordance with the embodiment of FIG. 1, showing a paint roller mounted in place on the holder.
FIG. 1B is a side view of the tool-mounting section in accordance with the embodiment of FIG. 1, rotated to show two protruding members.

As depicted in FIG. 3A-E, a tool-mounting section 70, including a tool such as a paint roller 71 (FIGS. 1A and 1B), can be locked or unlocked into handle member 20 by axially and rotationally adjusting the position of locking collar 40. In FIG. 1A, paint roller 71 is shown to be threaded into tool-mounting section 70, although any other manner of mounting the roller or other tool is also possible. It may also be that the roller or other tool is fabricated to be integral with tool-mounting section 70.

In order to mount tool-mounting section 70 to handle member 20 and retaining sleeve 30, as shown in FIG. 3B, retaining sleeve 30 is first retracted in a proximal direction against the bias of spring 50. Then, still as shown in FIG. 3B, tool-mounting section 70 is inserted into handle member 20 with protruding member 72 positioned at the proximal end of longitudinal-extending portion 23 of handle body aperture 22. As shown in FIG. 3C, tool-mounting section 70 is then rotated such that protruding member 72 moves to the left or far end of longitudinal-extending portion 23 of handle body aperture 22. At the same time, protruding member is moving to the left side of circumferentially-extending portion 33 of retaining sleeve aperture 32. Retaining sleeve 30 is then released to permit the bias of spring 50 to shift the retaining sleeve distally to the position depicted in FIG. 3D. Then locking collar 40 is rotated to the right from the position shown in FIG. 3D to that shown in FIG. 3E, thus preventing retraction of the retaining sleeve, and locking protruding member 72 between the proximal edge of longitudinal-extending portion 23 of retaining sleeve aperture 32 and the distal edge of circumferentially-extending portion 25 of handle member aperture 22. This in turn locks tool-mounting section 70 in place.

Although certain embodiments have been illustrated and described herein for purposes of description, a wide variety of alternate and/or equivalent embodiments or implementations calculated to achieve the same purposes may be substituted for the embodiments shown and described without departing from the scope of the present disclosure. This application is intended to cover any adaptations or variations of the embodiments discussed herein. Therefore, it is manifestly intended that embodiments described herein be limited only by the claims and the equivalents thereof.

What is claimed is:

1. An extension pole and tool holder apparatus, comprising:

a first rod having a distal end, a proximal end, and a first rod aperture extending from the distal end toward the proximal end and including a transversely-extending aperture portion that is longitudinally spaced from the distal end;

a second rod having a distal end and a proximal end, the second rod being substantially disposed in a telescoping, longitudinally-moveable arrangement with respect to the first rod, the second rod having a second rod aperture extending from the distal end toward the proximal end and including a longitudinally-extending aperture portion and a transversely-extending aperture portion; and a third rod having a protruding member extending transversely outwardly therefrom, the third rod being mountable within the first and second rods by the protruding member longitudinally extending toward the proximal end of the first rod aperture and distal end of the second rod aperture, transversely extending along the transversely-extending aperture portions of the first and second rod apertures toward the distal end of the longitudinally-extending aperture portion of the second rod, and longitudinally extending toward the proximal end of the longitudinally-extending aperture portion of the second rod, such that the protruding member is trapped within the transversely-extended aperture portion of the first rod aperture and the longitudinally-extended aperture portion of the second rod aperture.

2. The extension pole and tool holder of claim 1, further comprising a locking member positioned over the outermost of the first and second rods, and an inwardly-extending locking assembly to which the locking member is mounted for releasably locking the longitudinal position of the first and second rods with respect to each other.

3. The extension pole and tool holder apparatus of claim 2, wherein the locking member comprises a collar, including a collar aperture, mounted to the outermost of the first and second rods, the locking assembly comprises a pin assembly ring and a pin, the first and second rods each further comprising a pin aperture, the pin assembly ring having a distal end, a proximal end, and a groove extending from the distal end toward the proximal end, the pin being positioned in the proximal end of the groove and radially-extending through the pin apertures of the first and second rods and the collar aperture, such that the collar is displaceable in a first direction to lock the relative position of the first and second rods with respect to each other, and displaceable in a second direction to unlock the relative position of the first and second rods with respect to each other.

4. The extension pole and tool holder apparatus of claim 1, further comprising a biasing spring mounted between the first and the second rods such that the second rod is biased in a distal direction with respect to the first rod, thereby exerting a distal force on the protruding member when it is disposed within the first and second rod apertures.

5. The extension pole and tool holder apparatus of claim 1, further comprising a radially-extending sleeve pin that prevents relative rotation between the first and second rods.

6. The extension pole and tool holder apparatus of claim 5 wherein the first and second rod apertures each includes side edges that at least in part substantially conform to each other.

7. An extension pole and tool holder apparatus, comprising:

a first substantially cylindrical rod having a distal end and a proximal end and a first rod aperture extending from the distal end toward the proximal end, the first rod aperture including a longitudinally-extending portion and a circumferentially-extending portion, wherein the longitudinally-extending portion is at the distal end of the first rod, and the circumferentially-extending portion extends circumferentially from a proximal end of the longitudinally-extending portion;

a second substantially cylindrical rod having a distal end and a proximal end, the second rod being substantially disposed in a telescoping, longitudinally moveable arrangement with respect to the first rod, and having a second rod aperture substantially adjacent the first rod aperture and extending from the distal end toward the proximal end, the second rod aperture comprising a circumferentially-extending portion and a longitudinally-extending portion, wherein the circumferentially-extending portion is at the second rod distal end and the longitudinally-extending portion extends longitudinally from a proximal end of the circumferentially-extending portion; and a third rod having a protruding member extending radially outwardly from at least one side thereof, the third rod being mountable within the first and second rod such that the protruding member is trapped longitudinally by the circumferentially-extended portion of the first rod aperture and circumferentially by the longitudinally-extended portion of the second rod aperture.

8. The extension pole and tool holder apparatus of claim 7, further comprising a biasing element that biases the second rod in a distal direction with respect to the first rod.

9. The extension pole and tool holder of claim 7, further comprising means for locking the position of the first and second rods with respect to each other.

10. The extension pole and tool holder of claim 7, further comprising a collar positioned over the outermost of the first and second rods, the collar being moveable to lock and unlock the position of the first and second rods with respect to each other.

11. The extension pole and tool holder of claim 10 wherein the collar is rotatable from a locked to an unlocked position.

12. The extension pole and tool holder apparatus of claim 7 wherein the first and second rod apertures each includes side edges and the second rod is disposed in a telescoping, longitudinally-moveable arrangement with respect to the first rod such that the side edges at least in part substantially conform to each other and the longitudinally-extending portion of the second rod aperture extends from a side of the circumferentially-extending portion that is remote from the longitudinally-extending portion of the first rod aperture.

13. An extension pole and tool holder apparatus, comprising:

a first substantially cylindrical rod having a distal end and a proximal end and a first rod aperture extending from the distal end toward the proximal end, the first rod aperture including a longitudinally-extending portion and a circumferentially-extending portion, wherein the longitudinally-extending portion is at the distal end of the first rod, and the circumferentially-extending portion is disposed proximally of the distal end;

a second substantially cylindrical rod having a distal end and a proximal end, the second rod being substantially disposed in a telescoping arrangement with the first rod and being biased by a biasing element in a distal direction with respect to the first rod, and having a second rod aperture substantially adjacent the first rod aperture and extending from the distal end toward the proximal end, the second rod aperture comprising a circumferentially-extending portion and a longitudinally-extending portion, wherein the circumferentially-extending portion is at the second rod distal end, and a locking collar mounted to the outermost of the first and second rods, the locking collar being mounted to a radially-inwardly extending locking assembly, the collar being rotatable in a first direction to lock the relative position of the first and second rods with respect to each other, and rotatable in a second direction to unlock the relative position of the first and second rods with respect to each other; and a third rod having a protruding member extending radially outwardly therefrom, the third rod being mountable within the first and second rods such that the protruding member is trapped longitudinally by the circumferentially-extending portion of the first rod aperture and the circumferentially by the longitudinally-extending portion of the second rod aperture.

14. The extension pole and tool holder apparatus of claim 13 wherein the locking assembly includes a pin assembly ring disposed within the first and second rods, a sleeve pin positioned to align the apertures of the first and second rods, and a collar pin positioned to mount the collar over the outermost of the first and second rods and rotate the pin assembly ring, whereby rotation of the collar rotates the collar pin and the pin assembly ring.

15. The extension pole and tool holder apparatus of claim 14, wherein the bias to the second rod in a distal direction is provided by a spring mounted within the first and second rods, which biases the pin assembly ring in a distal direction against the sleeve pin aligning the first and second rods.

16. The extension pole and tool holder apparatus of claim 14, wherein the locking assembly prevents the second rod from moving longitudinally with respect to the first rod when the sleeve pin and collar pin are not radially parallel with each other, and allows such longitudinal movement when the sleeve pin and the collar pin are radially parallel with each other.

17. The extension pole and tool holder apparatus of claim 13 wherein the first and second rod apertures each includes sides that at least in part substantially conform to each other.

18. The extension pole and tool holder apparatus of claim 17 wherein the sides of the first and second rod apertures at least in part substantially conform to each other by the right side of the longitudinally-extending portion of the handle member aperture and the right side of the circumferentially-extending portion of the retaining sleeve aperture substantially conforming to each other, and the left edge of the circumferentially-extending portion of the first rod aperture and the left edge of longitudinally-extending portion of the second rod aperture substantially conforming to each other.

19. The extension pole and tool holder apparatus of claim 1, 7 or 13 wherein the third rod has distal and proximal ends, and the proximal end of the third rod is mounted to the first and second rods, further comprising a tool mounted adjacent the distal end of the third rod.

20. The extension pole and tool holder apparatus of claim 7 or 13 wherein the third rod is mountable within the first and second rods by the protruding member longitudinally extending toward the proximal end of the first rod aperture and distal end of the second rod aperture, circumferentially extending along the circumferentially-extending aperture portions of the first and second rod apertures toward the distal end of the longitudinally-extending aperture portion of the second rod, and longitudinally extending toward the proximal end of the longitudinally-extending aperture portion of the second rod, such that the protruding member is trapped within the circumferentially-extending aperture portion of the first rod aperture and the longitudinally-extended aperture portion of the second rod aperture.

* * * * *

UNITED STATES PATENT AND TRADEMARK OFFICE

CERTIFICATE OF CORRECTION

PATENT NO. : 8,490,250 B2
APPLICATION NO. : 13/311503
DATED : July 23, 2013
INVENTOR(S) : Scott M. Lanz It is certified that error appears in the above-identified patent and that said Letters Patent is hereby corrected as shown below:

In the Claims

Column 10
Lines 26-27, "...the circumferentially..." should read --...circumferentially....--.

Signed and Sealed this
Nineteenth Day of May, 2015

Michelle K. Lee

Michelle K. Lee
*Director of the United States Patent and Trademark Office*